United States Patent [19]

Ferguson et al.

[11] 4,401,975

[45] Aug. 30, 1983

[54] ELECTRICAL SYNTHESIS OF MECHANICAL BELL

[75] Inventors: Harry D. Ferguson; Michael K. Slack, both of Owen Sound, Canada

[73] Assignee: General Signal Corporation, Stamford, Conn.

[21] Appl. No.: 323,521

[22] Filed: Nov. 19, 1981

[51] Int. Cl.[3] ..... G08B 3/10

[52] U.S. Cl. ..... 340/384 E; 84/1.13; 84/1.22; 84/1.26

[58] Field of Search ..... 84/1.03, 1.13, 1.22, 84/1.23, 1.24, 1.25, 1.26, 1.27; 340/384 R, 384 E

[56] References Cited

U.S. PATENT DOCUMENTS

| | | | |
|---|---|---|---|
| 3,971,283 | 7/1976 | Wayne, Jr. | 84/1.26 |
| 3,986,426 | 10/1976 | Faulhaber | 84/1.26 X |
| 4,198,891 | 4/1980 | Weber | 84/1.26 X |

*Primary Examiner*—Stanley J. Witkowski

*Attorney, Agent, or Firm*—George W. Killian; Milton E. Kleinman

[57] ABSTRACT

Circuit means for synthesizing the sound of a mechanical bell by combining the three most significant frequencies of the bell to be synthesized and modulating these with a decaying exponential control signal which is derived from a clock signal having a pulse repetition rate equal to the stroke repetition rate of the bell being synthesized. The combined and modulated signal is amplified and coupled to suitable audio distribution means. Modulation of the exponential signal can provide a tremolo effect.

13 Claims, 1 Drawing Figure

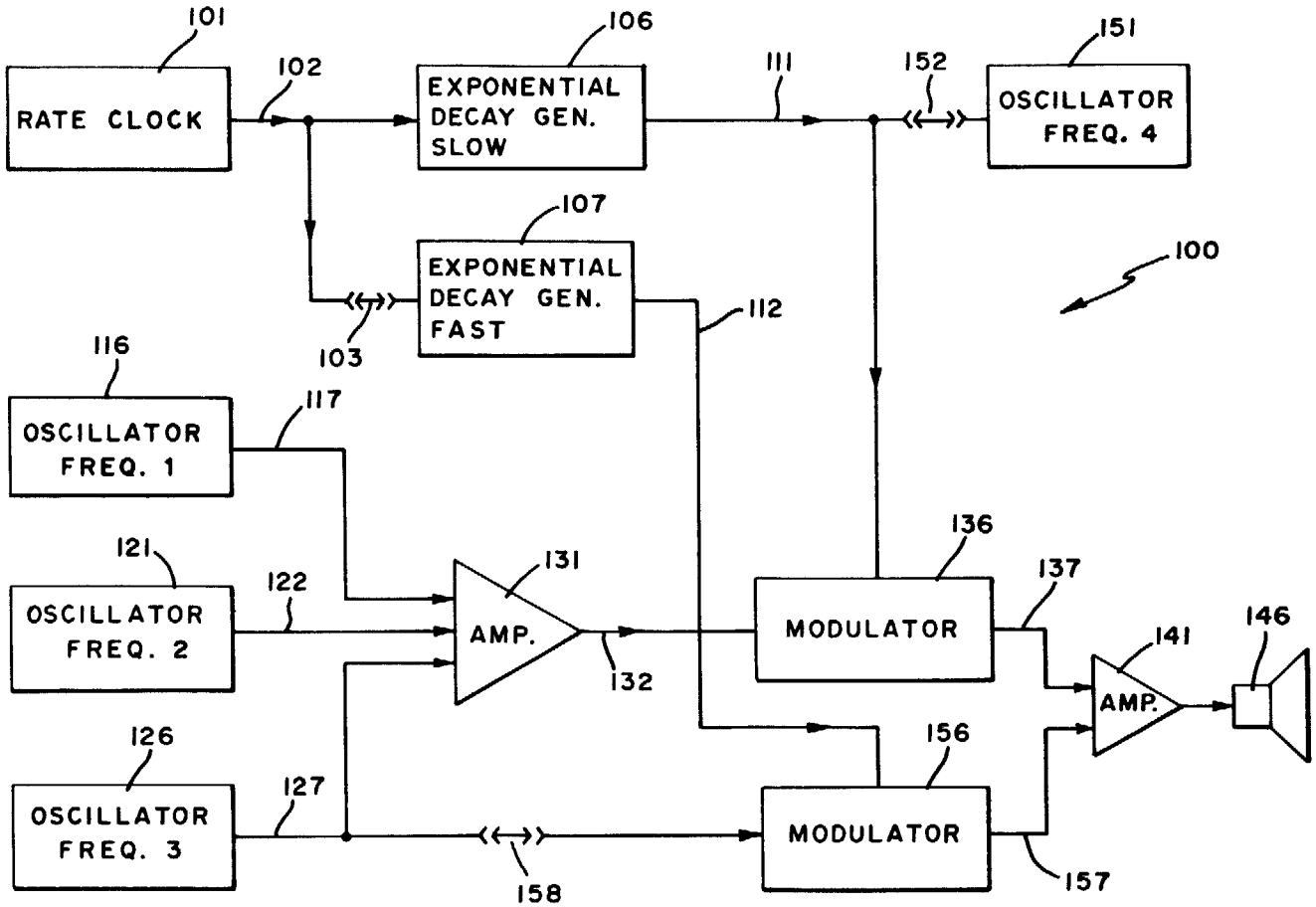
100
101
RATE CLOCK
102
106
EXPONENTIAL DECAY GEN. SLOW
107
EXPONENTIAL DECAY GEN. FAST
103
111
112
151
OSCILLATOR FREQ. 4
152
116
OSCILLATOR FREQ. 1
117
121
OSCILLATOR FREQ. 2
122
126
OSCILLATOR FREQ. 3
127
131
AMP.
132
136
MODULATOR
137
156
MODULATOR
157
158
141
AMP.
146

ELECTRICAL SYNTHESIS OF MECHANICAL BELL

BACKGROUND OF THE INVENTION

Edgar Alan Poe, in his poem entitled "The Bells", enumerated many ways in which bells may be used to indicate a wide variety of conditions and events. Poe contemplated principally the wide variety of bells which were struck with a clapper. Currently, the generic term "bells" also includes a wide variety of electrically operated devices, one of the most ubiquitous of which is the ordindary houshold doorbell comprising a gong which is repetitively struck in response to the actuation of an electromagnet. With the advance in technology, bell tones have been amplified and gongs and strikers have been designed to produce a wide variety of tones and sounds. In addition, electronic techniques have been used to generate a wide variety of other audible alarm signals. Police and/or ambulance sirens, as used in many municipalities, are typical and offer various advantages in sound volume, ruggedness, economy and reliability.

Because of the generations of use of percussive bell signals and our familiarity with and acceptance of their sound, there are still many applications wherein it is considered desirable to use percussive bells. However, percussive bells and their associated electromechanical striker mechanisms have a tendency to be unreliable and/or require routine adjustment and/or maintenance. In addition, these traditional devices tend to be bulkier and more expensive than electronic sound generation. Accordingly, in order to provide traditional bell tones and electronic economy and reliability, efforts have been made to reproduce bell sounds electronically. For the most part, such devices have merely imitated bell sounds and have included a wrong mix of harmonics to simulate authentic sounds. Other techniques have required such extensive and elaborate circuitry as to render then uneconomic except in highly specialized applications.

Copending application Ser. No. 323,520 filed Nov. 19, 1981 by Harry Ferguson, is entitled Electric Simulation of Percussive Bell and which is assigned to the same assignee as the present invention discloses circuit means for simulating the sound of a percussive bell and employs a square wave generator and a sine wave generator for producing signals of different frequencies with the square wave signal filtered to remove selected harmonics. The remaining signal and the other signals are each modulated with different decaying exponential control signals and the resultant signals mixed to provide a signal suitable for audio amplification.

Other examples of prior art devices may be seen in the following patents:

U.S. Pat. No. 2,354,699 issued Aug. 1, 1944 to E. L. Owens is a pertinent patent in that it teaches generation of voltages of the more important frequencies of the desired tones and the blocking of an amplifier with a decaying signal characteristic of percussion type signals.

U.S. Pat. No. 3,325,578, issued June 13, 1967 to D. M. Park, teaches the use of two tuned circuits which produces frequencies which are not harmonically related. A triggering pulse source causes damped oscillations in the tuned circuits and exponentially decaying sound for simulating a cow bell.

U.S. Pat. No. 3,460,136, issued Aug. 5, 1969 to C. M. Jambazian, provides a device in which two signals of different frequencies are operated on to produce an output providing characteristics similar to the sound produced by birds and the like.

U.S. Pat. Nos. 3,218,636 and 3,742,492, issued Nov. 16, 1965 and June 26, 1973 to J. M. Bernstein et al. and D. F. Proctor, respectively, disclose techniques for producing sounds electronically and use piezoelectric devices.

U.S. Pat. No. 2,455,472, issued Dec. 7, 1948 to H. C. Curl et al. discloses a means for the selective generation of selected complex tones by frequency modulation to produce signals having a large number of frequency components.

U.S. Pat. Nos. 3,249,933 and 4,092,893, issued May 3, 1966 and June 6, 1978 to R. W. McKee and R. O. Beach, respectively, teach sound generation through amplifiers after striking a vibrating member.

U.S. Pat. No. 3,587,094, issued June 22, 1971 to R. Scott, teaches a generation of a variety of sounds through the use of random voltage generators, voltage controlled tone generators, pulsers, triggers, pulse shapers, keyers, audio generators, delay devices, amplifiers and loud speakers.

U.S. Pat. No. 4,180,808, issued Dec. 25, 1979 to J. P. Lebet et al. discloses another system using a piezoelectric transducer together with a means for controlling the applied potential.

SUMMARY OF THE INVENTION

The audio sound of a selected mechanical bell is electrically synthesized by first analyzing the sound of the bell to be synthesized and determining the frequencies of the three dominant frequencies within the many frequencies and harmonics which combine to produce the bell sound. Oscillators for generating signals of the three dominant frequencies and a rate clock for providing pulses at the desired pulse repetition rate are provided. From the rate clock a decaying exponential is obtained as a control signal which is used to modulate the three oscillator signals. Modulation of the decaying exponential signal can provide a tremolo effect. A further sound refinement may be added by use of another modulator which modulates the highest of the three frequencies with a decaying exponential which has a time constant less than that of the first mentioned time constant. This provides a burst of high frequency sound to synthesize the sound of the plunger first striking the gong.

It is an object of this invention to provide a new and improved electronic circuit for synthesizing the sound of a percussive bell.

It is a more specific object of the invention to provide a synthesizing circuit which synthesizing the sound of a specific percussive bell with reasonable authenticity.

It is another object of the invention to provide a circuit of the character described which faithfully synthesizes the desired sound with a minimum number of electrical components.

It is another object of the invention to produce a circuit of the character described which is economical and reliable and does not require field maintainence or adjustment.

It is another object of the invention to provide an electronic circuit for synthesizing the sound of a mechanical bell and which includes a tremolo effect.

It is another object of the invention to provide means for synthesizing the initial clunk of the plunger on the gong.

It is another object of the invention to provide means for introducing a tremolo effect.

BRIEF DESCRIPTION OF THE DRAWING

To permit an incisive and detailed analysis of the principles and operational characteristics of the invention, the principles thereof are disclosed in a single figure comprising a block diagram of the components disclosing the concept. The block diagram is intended to disclose the general principles of the invention and is not meant, in any way, to delimit its scope. It is rather so drawn as an aid in understanding the invention without the inclusion of detailed circuit elements which would only tend to obscure the concepts. In the drawing:

The FIGURE comprises a block diagram of the principal components of the invention.

DESCRIPTION OF THE PREFERRED EMBODIMENT

Considering now more specifically the FIGURE, there will be seen therein a block diagram of the major components comprising the electronic means for simulating the sound of a percussive bell. The circuit is indicated generally as 100. The electronic bell comprises a rate clock 101 which may produce a signal of a predetermined frequency generally falling within the range of a few strokes per minute to a few hundred strokes per minute. That is, the rate clock 101 produces a signal at a frequency corresponding to the pulse repetition rate of the bell which is to be electronically synthesized and the pulse repetition rate of such bells generally fall within the range of a few strokes per minute, such as approximately five or twenty to a few hundred strokes per minute such as two or three hundred to perhaps five or six hundred strokes per minute.

In addition to the exponential decay generator 106 there is also an optional exponential decay generator 107 which will serve a function to be described more fully hereinafter. The optional nature of the exponential decay circuit 107 is indicated schematically by the optional wiring 103 which indicates exponential decay generator 107 may or may not be connected to the lead 102. The exponential decay generator 107, when provided, produces a decay circuit with a predetermined time constant which is faster than the time constant of the exponential decay generator 106. The outputs of the exponential decay generators 106 and 107 are applied to leads 111 and 112, respectively.

The bell which it is desired to be synthesized should have its audio signal analyzed to determine the three most significant frequencies which comprise its make-up. For a specific example, the audio signal was found to comprise frequencies of 576 Hertz, 1485 Hertz and 2750 Hertz. Oscillators for providing each of the three significant frequencies are provided and designated 116, 121 and 126 in the drawing with oscillators 116 and 126 generating the lowest and highest frequencies, respectively. It should be understood that the cited frequencies are illustrative of a specific example and that other suitable frequencies could be used. Each of the oscillators 116, 121 and 126 produce sinusoidal output signals. However, if it were expedient to do so, it would be possible to utilize square wave generators together with filters which filter out the principal undesired frequencies.

The outputs of the oscillators 116, 121 and 126 are applied to leads 117, 122 and 127, respectively, and then applied as an input to amplifier 131.

The output of the amplifier 131 is applied to lead 132 as an input to modulator 136 which produces an output on lead 137. The amplifier 131 mixes the three signals on leads 117, 122 and 127 and if desired, each of the oscillators 116, 121 and 126 may include adjusting means for controlling the magnitude of their respective output signals. The output signal on lead 137 of the modulator 136 comprises the output of amplifier 131 as modulated by the signal from the exponential decay generator 106. The signal on lead 137 is amplified by audio amplifier 141 which provides an output signal to one or more loud speakers 146 and/or other audio components.

Suitable volume control means may be provided in association with audio amplifier 141 and if desired, an isolation transformer (not shown), may be included between the audio amplifier 141 and the loud speakers 146. Further, using common and well known techniques the volume of individual loud speaker 146 may be controlled.

If it is desired to include a tremolo effect in connection with the synthesized bell signal, a fourth oscillator 151 having a frequency of only a few cycles per second may be added to the system. The optional inclusion of the oscillator 151 is indicated by the optional wiring 152. That is, if the oscillator 151 is included there is a connection 152 between the oscillator 151 and the lead 111. The oscillator 151 will serve to modulate the exponential decay signal from the exponential decay generator 106, thereby modifying the output of modulator 136 so that the output signal on lead 137 will include a tremolo effect.

As previously set forth the system may include an exponential decay generator 107 which is connected by means of optional wiring 103. When this equipment is furnished a modulator 156 is also included. The modulator 156 will have as an input the exponential decay signal on lead 112 and a signal from oscillator 126 on lead 127 through optional wiring 158. The output of the modulator 156 will appear on lead 157 and be applied as an additional input to the amplifier 141. The exponential decay generator 107 will produce a decay signal which will decay faster than the signal produced by exponential decay generator 106. The addition of the exponential decay generator 107 and the modulator 156 which act on the output signal from oscillator 126 provides a "clunk" sound. For the purposes of this description a "clunk" sound may be described as the initial sound of the striker striking the gong. If the gong of a mechanical bell is damped, as by holding it with the fingers, and the hammer allowed to strike the gong a "clunk" sound will be heard. If the gong is not damped there will be a rich variety of subsequent harmonics following the original strike of the gong such that, for many, the initial "clunk" will be overridden. Accordingly, many people will not be sensitive to the absence of the "clunk" sound if it is not synthesized. However, in those situations where it is desirable to synthesize the "clunk" as well as the other signals, the optional apparatus and wiring may be provided as described.

The "clunk" sound which has been defined as the sound of the striker, or plunger, hitting the gong without all the subsequent resonant ringing of the gong comprises a burst of high frequency noise and adds realism to the synthesized sound. The "clunk" will occur once each cycle of operation or, more specifically, at the rate determined by the rate clock 101 which may be a rate ranging from a few strokes per minute to a few hundred strokes per minute. Thus, typical clock rates migh fall within the range of 20 cycles per minute to 300 cycles per minute. Other rates could, of course, be used to synthesized other special application bells.

A mechanical bell has a very high, dynamic range. That is there is a high initial coustic output and the sound decays to a barely audible or inaudible sound. The circuits chosen for the synthesizer must accommodate this high, dynamic range which is of the order of 60 decibels and should provide little, if any, background noise between bell strokes. The dynamic range may be defined as the ratio between the maximum sound output and the minimum sound output.

While there has been shown and described what is considered at present to be a preferred embodiment of the invention, modifications thereto will readily occur to those skilled in the related arts. For example, in another structure additional dominant frequencies, and/or harmonics, could be added to further heighten the realism of the synthesized ball. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. A circuit for the electrical synthesis of a mechanical bell sound and comprising in combination:

(a) a rate clock for providing signals at a predetermined stroke repetition rate;

(b) a first exponential decay circuit coupled to said rate clock for producing a first decaying exponential control signal having a first predetermined time constant;

(c) a second exponential decay circuit coupled to said rate clock for producing a second decaying exponential control signal having a second predetermined time constant;

(d) first, second and third oscillators for producing signals of first, second and third frequencies, respectively, which comprise the low, intermediate and high frequencies, respectively, of the three most significant frequencies, other than that of the stroke repetition rate, of the mechanical bell to be synthesized;

(e) a first modulator adapted to produce a first output signal which is a function of two input signals and with said first control signal coupled to said modulator as one of the inputs thereto;

(f) a second modulator adapted to produce a second output signal which is a function of two input signals with said second control signal coupled to said second modulator as one of the inputs thereto;

(g) means for coupling said first, second and third frequencies to said first modulator as a second input thereto;

(h) means for coupling said third frequency to said second modulator as a second input thereto;

(i) means for coupling the output of said first modulator to suitable audio means; and (j) means for coupling the output of said second modulator to said suitable audio means.

2. The combination as set forth in claim 1 wherein said predetermined time constant is of the order of not more than a few seconds.

3. The combination as set forth in claim 1 wherein any of said first, second and third frequencies may include harmonics.

4. The combination as set forth in claim 1 wherein said first, second and third frequencies may have a dominant frequency of the order of 575, 1500 and 2800 Hertz, respectively.

5. The combination as set forth in claim 1 wherein said second time constant is less than said first named time constant.

6. The combination as set forth in claim 5 wherein said time constant are of the order of not more than a few seconds.

7. The combination as set forth in claim 1 and including low frequency modulating means for modulating said control signal.

8. The combination as set forth in claim 1 wherein said first, second and third frequencies are all within the audio range.

9. The combination as set forth in claim 1 wherein said second frequency is of the order of two to four times said first frequency and said third frequency is of the order of four to six times said first frequency.

10. The combination as set forth in claim 1 wherein said stroke repetition rate is of the order of a few to a few hundred cycles per minute.

11. The combination as set forth in claim 1 wherein said first, second and third oscillators product sinusoidal signals.

12. The combination as set forth in claim 11 wherein said first, second and third oscillators are Wien bridge oscillators.

13. The combination as set forth in claim 12 wherein each of said first, second and third oscillators includes potentiometer means for adjusting the amplitudes of their respective output signals.

* * * * *